US005541030A

United States Patent [19]

Sano et al.

[11] Patent Number: 5,541,030

[45] Date of Patent: Jul. 30, 1996

[54] TONER FOR DEVELOPING A DIGITAL IMAGE

[75] Inventors: Tetsuo Sano, Amagasaki; Masao Nakajima, Itami; Hideaki Tsukamoto, Kawabe-gun; Yoshitaka Sekiguchi, Amagasaki; Hiroyuki Fukuda, Kobe, all of Japan

[73] Assignee: Minolta Co., Ltd., Osaka, Japan

[21] Appl. No.: 397,943

[22] Filed: Mar. 3, 1995

[30] Foreign Application Priority Data

Mar. 4, 1994 [JP] Japan ..... 6-034667

[51] Int. Cl.[6] ..... G03G 9/083; G03G 9/087; G03G 9/097

[52] U.S. Cl. ..... 430/106.6; 430/109; 430/110

[58] Field of Search ..... 430/106.6, 109, 430/110

[56] References Cited

U.S. PATENT DOCUMENTS

| | | | |
|---|---|---|---|
| 4,558,668 | 5/1986 | Yasuda et al. | 430/109 |
| 4,626,487 | 12/1986 | Mitsuhashi et al. | 430/109 |
| 4,657,837 | 4/1987 | Morita et al. | 430/109 |
| 4,833,057 | 5/1989 | Misawa et al. | 430/109 |
| 4,863,824 | 9/1989 | Uchida et al. | 430/109 |
| 4,917,982 | 4/1990 | Tomono et al. | 430/99 |
| 4,933,251 | 6/1990 | Ichimura et al. | 430/109 |
| 4,933,252 | 6/1990 | Nishikawa et al. | 430/109 |
| 5,234,787 | 8/1993 | Morimoto et al. | 430/106.6 |
| 5,234,788 | 8/1993 | Morimoto et al. | 430/106.6 |

FOREIGN PATENT DOCUMENTS

| | | | |
|---|---|---|---|
| 90344 | 5/1985 | Japan | 430/109 |
| 82267 | 3/1990 | Japan | 430/109 |
| 229264 | 10/1991 | Japan | 430/109 |

*Primary Examiner*—Roland Martin

*Attorney, Agent, or Firm*—McDermott, Will & Emery

[57] ABSTRACT

A toner for developing a digital-image and being fused onto a recording medium by heat and pressure, said toner comprising: a coloring agent; a first polyester resin having a softening temperature of 105° C.~112° C.; a second polyester resin having a softening temperature of 150° C.~155° C. wherein a mix ratio of the first resin to the second resin is between from 75/25 to 40/60 and an oxided polyolefine. Said toner has a characteristics of a high reproductivity of a digital dot image, a high fixing-strength, a wide range of an offset boundary temperature and an anti-filming property.

27 Claims, No Drawings

TONER FOR DEVELOPING A DIGITAL IMAGE

BACKGROUND OF THE INVENTION

1. Field of the Invention

The present invention relates to a toner for developing electrostatic latent images, and more specifically relates to a toner for developing electrostatic latent images fused by heat and pressure for use in electrophotographic apparatus of a digital type.

2. Description of the Related Art

Conventional electrophotographic apparatus in general use are typically electrophotographic apparatus of an analog type for copiers and the like which expose a document with light from a light source and form an electrostatic latent image on a photosensitive member by means of the light reflected from said exposed photosensitive member. Electrophotographic apparatus of a digital type which develop images by supplying a developer including a toner to an electrostatic latent image formed by dot units obtained by digital writing methods have been realized for facsimiles of the electrophotographic type, digital copiers which form images based on image information read by an image reader, or printers using the output from a computer terminal.

In electrophotographic apparatus of a digital type, an electrostatic latent image is formed in dot units on the surface of a photosensitive member by digital writing thereon via exposure by a light beam, said electrostatic latent image is developed standard development or reversal development using a toner, transferring the obtained toner image onto a recording medium such as paper or the like, and fusing the transferred toner image onto the recording medium to produce the recorded image. Toners used in the aforesaid digital methods are required to have minimal running together of dots caused by toner breakdown during transfer and fixing, i.e., excellent dot reproducibility. When dot reproducibility is poor, low density halftone reproducibility is lost and image breakdown results, causing reduced image quality.

On the other hand, toner fixing methods used in conventional electrophotographic apparatus typically use heat and pressure fixing methods providing an arrangement of a heating roller having a heat-resistant elastic layer of silicon or the like or a heat-resistant separation layer of polytetrafluoroethylene (PTFE) superimposed over the surface of a metal core provided with an internal heating means, and a pressure roller provided with a heat-resistant layer on the surface thereof which makes pressure contact with said heating roller, wherein a toner image is fixed when a transfer medium bearing a toner image on the surface thereof passes between said rollers.

In the aforesaid type of heating and pressure fixing method, during fixing a portion of the toner is transferred to the fixing roller through contact of the toner with the pressure roller or like fixing roller or film member while in a heat fusion state, said portion of toner thereafter being again transferred to a subsequent transfer member and causing an offset phenomenon. Furthermore, dot reproducibility may be reduced due to pressure-induced toner deformation. Thus, toners used in heat and pressure fixing methods are required to have excellent offset resistance and dot reproducibility.

The previously described electrophotographic apparatus are available in a wide variety of types from low speed to high speed, or low to high fixing temperature apparatus.

Since the speed with which the toner passes through the heating roller fixing device differs depending on the speed of the system, the toner is required to have a range of fixing efficiency, so as to be normally suitable for a specific apparatus type. However, using a different toner for each apparatus type in disadvantageous from the perspective of cost of manufacturing the toners, and it is therefore desirable to provide a toner that can be used for a broad range of apparatus regardless of system speed or fixing temperature.

SUMMARY OF THE INVENTION

An object of the present invention is to eliminate the previously described disadvantages, by providing a toner for use in developing electrostatic latent images formed by digital writing in dot units and fused by heat/pressure fixing and which has excellent dot reproducibility and superior fixing efficiency.

A further object of the present invention is to provide a toner for use in developing electrostatic latent images fused by heat and pressure and having excellent offset resistance and which does not damage the photosensitive member through filming or the like.

A still further object of the present invention is to provide a toner for use in developing electrostatic latent images fused by heat/pressure fixing and which is usable in a broad range of apparatus regardless of the system speed of the electrophotographic apparatus.

The present invention provides a toner for use in digital image forming apparatus and which is fused by heat and pressure, said toner comprising:

a coloring agent;

a polyester resin A having a softening temperature of 105°~112° C. including at least a polycondensated ether diphenol and one or more constituents from a group consisting of a compound of a bivalent aromatic carbonic acid, an anhydride acid thereof and a low-molecular alkyl ester thereof, and a polyester resin B having a softening temperature of 150°~155° C. including at least a polycondensated ether diphenol and one or more constituents from a group consisting of a compound of a bivalent aromatic carbonic acid, an anhydride acid thereof and a low molecular alkyl ester thereof, and a carbonic acid having a polyvalent value greater than a trivalent value, an anhydride acid thereof and a low-molecular alkyl ester thereof and a polyhydric alcohol having a polyvalent value greater than a trivalent value, and wherein the mixture ratio of the said binder resin A to binder resin B is between 75/25 to 40/60 parts by weight; and an offset inhibitor comprising an oxidated polyolefin 1~6 parts by weight of the binder resin.

The present invention further provides a toner for use in digital image forming apparatus and which is fused by heat and pressure, said toner comprising:

a polyester resin A having a softening temperature of 105°~112° C. and a polyester resin B having a softening temperature of 150°~155° C., and wherein the mixture ratio of binder resin A to binder resin B is between 75/25 to 40/60 parts by weight;

colored resin particles including an offset inhibitor having an acid value of 3~25, and a coloring agent; and silica particles having a BET (Brunauer, Emmett, and Teller) specific surface area of 80~150 $m^2/g$ added to said colored resin particles.

DESCRIPTION OF THE PREFERRED EMBODIMENTS

Examples of useful polyester resin A used for the binder resin in the toner of the present invention include polycondensated ether diphenol, bivalent carbonic acid, hydric acid thereof and low-molecular alkyl ester thereof, or polycondensated ether diphenol, bivalent carbonic acid, or anhydric acid thereof and low-molecular alkyl ester thereof, carbonic acid having a polyvalent value greater than a trivalent value, an anhydride acid thereof and a low-molecular alkyl ester thereof and a polyhydric alcohol having a polyvalent value greater than a trivalent value.

Examples of ether diphenol useful for polyester resin A include polyoxypropylene bisphenol A such as polyoxypropylene (2,2)-2, 2-bis(4-hydroxyphenyl) propane, polyoxypropylene (3,3)-2,2-bis(4-hydroxyphenyl) propane, polyoxypropylene (6)-2,2-bis(4-hydroxyphenyl)propane and the like, and polyoxyethylene bisphenol A such as polyoxyethylene (2,0)-2,2bis(4-hydroxyphenyl) propane and the like.

Examples of useful bivalent carbonic acid constituents include maleic acid, fumaric acid, citraconic acid, itaconic acid, glutamic acid, phthalic acid, isophthalic acid, terephthalic acid, cyclohexanedicarbonic acid, succinic acid, adipic acid, sebacic acid, azelaic acid, malonic acid, alkenylsuccinic acid and alkylsuccinic acid, and anhydride acid thereof and low-molecular alkyl ester.

Examples of useful carbonic acid constituents with a polyvalence value greater than a trivalent value include 1,2,4-benzene tricarbonic acid (trimellitic acid), 1,2,5-benzene tricarbonic acid, 2,5,7-naphthalene tricarbonic acid, 1,2,4-naphthalene tricarbonic acid, 1,2,4-butane tricarbonic acid, 1,2,5-hexane tricarbonic acid, 1,3-dicarboxy-2-methyl-2-methylenecarboxypropane, 1,2,4-cyclohexane tricarbonic acid, tetra(methylenecarboxyl) methane, 1,2,7,8-octanetetracarbonic acid, pyromellitic acid, and anhydride acid thereof and low-molecular alkyl ester.

Examples of useful polyvalent alcohols having a polyvalence value greater than a trivalent value include sorbitol, 1,2,3,6-hexanetetrol, 1,4-sorbitane, pentaerythritol, dipentaerythritol, tripentaerythritol, 1,2,4-butanetriol, glycerol, 2-methylpropanetriol, 2-methyl- 1,2,4-butanetriol, trimethylolethane, trimethylolpropane, 1,3,5-trihydroxy methylbenzene and the like.

Examples of ether diphenol particularly useful for polyester resin A include polyoxyethylene bisphenol A and polyoxypropylene bisphenol A together with a bivalent aromatic carbonic acid as a bivalent carbonic acid, and trivalent aromatic carbonic acid as a carbonic acid having a polyvalence value greater than a trivalent value.

Polyester resin A should have a softening temperature of 105°~12° C. to improve low temperature adhesion characteristics of the toner. When the softening temperature is less than 105° C., toner breakdown readily occurs, leading to a reduction in dot reproducibility and unsatisfactory digital image reproducibility. When the softening temperature is greater than 112° C., improved toner adhesion in the low temperature range is inadequate.

Polyester resin B may be produced using the same ether diphenol, bivalent carbonic acid, and trivalent aromatic carbonic acid, and carbonic acid having a polyvalence value greater than a trivalent value as monomers of polyester resin A.

Examples of ether diphenol particularly useful for polyester resin B include polyoxyethylene bisphenol A and polyoxypropylene bisphenol A together with a bivalent aromatic carbonic acid as a bivalent carbonic acid, and a bivalent carbonic acid and trivalent aromatic carbonic acid as a carbonic acid having a polyvalence value greater than a trivalent value.

Polyester resin B should have a softening temperature of 150°~155° C. When the softening temperature is less than 150° C, high temperature offset readily occurs. When the softening temperature is greater than 155° C, toner adhesion characteristics are impaired.

The mixture ratio of polyester resin A to polyester resin B is within a range of 75/25 to 40/60 so as to minimize spreading of toner due to toner breakdown during fixing, thereby achieving excellent dot reproducibility and assuring a broad fixing range from low temperature to high temperature. Furthermore, excellent dot reproducibility can be maintained during duplex image formation (when making two passes between the fixing rollers). When the percentage of polyester resin A is less than the previously mention range, low temperature fixing characteristics become unsatisfactory and fixing characteristics over a broad range of temperatures cannot be assured. When the percentage of polyester resin B is less than the aforesaid range, toner breakdown increases during fixing, thereby reducing dot reproducibility.

The toner of the present invention uses a mixture of two types of polyester resins having two different softening temperature ranges so as to have a broad range of fixing characteristics to prevent offset to the fixing roller when used in fixing methods utilizing heat and pressure in temperature ranges from low temperature to high temperature and to maintain reproducibility of dot units of digital images. However, polyester resin B in particular has a relatively high temperature softening temperature, and does not provide adequate prevention of offset phenomenon when used alone in conjunction with polyester resin A.

This situation is believed to be due to the difficulty of maintaining fixing characteristics because of the high softening temperature of polyester resin B to prevent dot breakdown, or dot structure when polyester resin B is formulated by a polyvalent carbonic acid.

Accordingly, the use of an offset inhibitor is required.

As previously described, offset may be inadequately prevented due to the low compatibility of polyester resin B with conventionally used low molecular weight polyethylene and polypropylene due to its high softening temperature. Or when polyester resin B has a reticular structure due to the use of polyvalent carbonic acid with a valence value greater than a trivalence value, compatibility is particularly reduced relative to low molecular weight polyethylene and polypropylene used as normal release agents, such that offset cannot be adequately prevented. Thus, when a release agent is mixed with the toner as microparticles during the pulverization process of manufacture, said microparticles fuse to the photoconductive member and attach to the carrier.

In view of the aforesaid information, an offset inhibitor having excellent compatibility with resin is required in the present invention.

When a polar group (carboxy group and the like) is present in the structure of the offset inhibitor, excellent compatibility is attained by relative to the polar groups within polyester resins A and B. Specifically, particularly excellent compatibility is attained when the offset inhibitor has a polar group with an acid value of 3~25.

Examples of such offset inhibitors include oxided polyolefins and the like.

Oxided polyolefins have excellent compatibility with polyester resins A and B because they have a polar group (carboxyl group) in their internal structure, and suitable acid value. The provide an excellent offset inhibitor and eliminate adhesion of the release agent on the photosensitive member and the like as previously described.

Examples of useful oxidated polyolefins include commercial products such as Sanwax E-250P (acid value: 19.5; Sanyo Chemical Industries, Ltd.), Sanwax E-310 (acid value: 15; Sanyo Chemical Industries, Ltd.), Hiwax 4052E (acid value: 20; Mitsui Petrochemical Industries, Ltd.), Hiwax 4053E (acid value: 25; Mitsui Petrochemical Industries, Ltd.), Hiwax 4202E (acid value: 17; Mitsui Petrochemical Industries, Ltd.) and like oxidated polyethylenes, and biscol TS-200 (acid value: 3.5; Sanyo Chemical Industries, Ltd.) and like polypropylenes. It is desirable that the product used have an acid value of 3~25 relative to compatibility with polyester resins A and B.

The aforesaid oxidated polyolefins are added at a rate of 1.0~6 parts by weight relative to 100 parts by weight of the binder resins. When the added amount is less than 1.0 parts by weight, adequate offset prevention is not obtained, whereas when the added amount is greater than 6.0 parts by weight, there is not adequate compatibility with the binder resins, which leads to filing of the photosensitive member.

The toner of the present invention may also include charge controlling agents, magnetic powder and the like as required.

Examples of useful charge controlling agents include chrome complex salt type azo pigments S-32, 33, 34, 35, 37, 28, and 40 (Oriental Chemical Industries, Ltd.), TRH and BHH (Hodogaya Chemical Co., Ltd.), T-22, 004 (Nippon Kayaku K. K.), copper phthalocyanine pigment S-39 (Oriental Chemical Industries, Ltd.), chrome complex salts E81, 82 (Oriental Chemical Industries, Ltd.), zinc complex salt E-84 (Oriental Chemical Industries, Ltd.), Aluminum complex slat E-86 (Oriental Chemical Industries, Ltd.), E89 (Oriental Chemical Industries, Ltd.), iron complex salt T-77 (Hodogaya Chemical Co., Ltd.).

Examples of useful magnetic powders include common magnetic micro particles such as strongly magnetic metals such as cobalt, iron, nickel and the like, metal alloys such as cobalt, iron, nickel, aluminum, lead, magnesium, zinc, antimony, beryllium, bismuth, cadmium, calcium, manganese, selenium, titanium, tungsten, vanadium and the like, and compounds, oxides, and calcined materials (ferrite) thereof.

When silica particles are added to the toner of the present invention, it is desirable that the BET specific surface area be 80~150 $m^2/g$.

Use of silica particles having the aforesaid BET specific surface area improves dot reproducibility and transfer characteristics of the toner image formed on the surface of a photosensitive member when transferred to a recording medium such as paper and the like.

Furthermore, silica particles with the aforesaid BET specific surface area improve flow characteristics and the added amount may be increased without loss of environmental stability compared to the use of flow enhancing agents typically having surface areas of 200 $m^2/g$ relative to toner having a mean particle size of 5~9 μm and which reduce flow characteristics.

It is desirable that the silica used be treated by hydrophobic processing to improve environmental stability, and a silane coupling agent, higher fatty acid, silicone oil or the like may be used as the hydrophobic agent.

Environmental stability can be further improved by adding silica together with electrically conductive microparticles. It is desirable that these electrically conductive microparticles are iron oxide, or conductive titanium oxide subjected to conductive processing by iron oxide-antimony oxide.

The amount of silica added to the toner is in the range of 0.05~2 percent by weight, and preferably 0.1~1 percent by weight, and toner and silica may be mechanically mixed to achieve the addiction of silica.

The addition of silica in the aforesaid range not only improves digital image dot reproducibility, but also improves moisture resistance and flow characteristics.

The surface of the toner of the present invention may be finally treated by a fluidizing agent other than silica. The process of said fluidizing treatment may be accomplished by mechanically mixing the toner and fluidizing agent. Examples of useful fluidizing agents include titanium dioxide particles, alumina particles, magnesium fluoride particles, silicon carbide particles, boron carbide particles, titanium carbide particles, zirconium carbide particles, boron nitride particles, titanium nitride particles, zirconium nitride particles, magnetite particles, molybdenum sulfide particles, aluminum stearate particles, magnesium stearate particles, zinc stearate particles and the like used individually or in combinations of two or more. The amount of added fluidizing agent is desirably 0.05~2 percent by weight, and preferably 0.1~1 percent by weight. When fluidizing agent is added in the aforesaid amount, flow characteristics are improved without loss of environmental stability of the developer. It is also desirable that the fluidizing agent be treated by hydrophobic processing to improve environmental stability. Examples of useful agents for hydrophobic treatment include silane coupling agent, titanium coupling agent, higher fatty acid, silicone oil and the like. It is desirable that the aforesaid fluidizing agent have a BET specific surface area of 80~150 $m^2/g$. Fluidizing agent with the aforesaid BET specific surface area improves flow characteristics and the added amount may be increased without loss of environmental stability compared to the use of flow enhancing agents typically having surface areas of 200 $m^2/g$ relative to toner having a mean particle size of 5~9 μm and which reduce flow characteristics. The use of the aforesaid fluidizer not only improves flow characteristics, but also improves transfer characteristics when transferring a toner image formed on the surface of a photosensitive member onto a transfer medium such as paper or the like, and further improves dot reproducibility. Environmental stability can also be improved by treating the aforesaid fluidizing agent together with electrically conductive microparticles. It is desirable that conductive titanium oxide treated by conductive processing with tin oxide or tin oxide-antimony oxide be used as the conductive particles.

The toner of the present invention may be used as a two-component developer comprising a carrier and a toner, or a monocomponent developer without a carrier. The carrier used in a two-component developer may be any common carrier.

Although the present invention is described by way of specific examples hereinafter, it is to be noted that the present invention is not limited to these examples.

Production of polyester resin A

Twenty-one four-hole flasks were mounted to a reflux condenser, reflux condenser, moisture separator, nitrogen gas inlet tube, temperature gauge, and mixer, and placed in a mantle heater. Alcohol preparations included 35 g of polyoxypropylene (2,2)-2,2-bis(4-hydroxyphenyl) propane and 292.5 g of polyoxyethylene(2,0)-2,2-bis(4-hydroxyphenyl) propane, and bivalent carbonic acid preparations included 448.2 g terephthalic acid, and trivalent carbonic acid preparation included 22 g trimellitic acid, which were reacted by mixing at 220° C. under nitrogen gas within the flask. The reaction was sustained with constant measurement of acid value, and the reaction was terminated when a predetermined acid value was attained, to produce polyester resins A1~A5 having the softening temperatures described below. The softening temperature of polyester resin A1 was 105.1° C., resin A2 had a softening point of 111.4° C., resin A3 had a softening point of 108.3° C., resin A4 had a softening point of 103. 7° C., and resin A5 had a softening temperature of 118.3° C. Using a high-performance flow tester (model CFT-500; Shimadzu Seisakusho K. K.), softening temperatures were measured using a 1 $cm^2$ specimen melted and discharged with measurement taken at ½ the height from the start of discharge to the end of discharge under the following conditions: dice pore diameter of 1 mm, pressure of 20 $kg/cm^2$ temperature rise of 6° C./min Production of polyester resin B Twenty-one four-hole flasks were mounted to a reflux condenser, reflux condenser, moisture separator, nitrogen gas inlet tube, temperature gauge, and mixer, and placed in a mantle heater. Alcohol preparations included 735 g of polyoxypropylene (2,2)-2,2-bis(4-hydroxyphenyl) propane and 292.5 g of polyoxyethylene(2,0)-2,2-bis(4-hydroxyphenyl) propane, and bivalent carbonic acid preparations included 249 g terephthalic acid and 177 g of succinic acid, and trivalent carbonic acid preparation included 22 g trimellitic acid, which were reacted by mixing at 220° C. under nitrogen gas within the flask. The reaction was sustained with constant measurement of acid value, and the reaction was terminated when a predetermined acid value was attained, to produce polyester resins B1–B5 having the softening temperatures described below. The softening temperature of polyester resin B1 was 150.1° C., resin B2 had a softening point of 154.2° C., resin B3 had a softening point of 152.5° C., resin B4 had a softening point of 142.9° C., and resin B5 had a softening temperature of 158.6° C.

| Toner 1 | |
|---|---|
| Polyester resin A (SP = 1.5.1° C.) | 65 pbw |
| Polyester resin B (SP = 1.5.1° C.) | 35 pbw |
| Oxidated polypropylene (biscol TS-34; Sanyo Kasei Kogyo Acid value: 3.5) | 3 pbw |
| Charge controlling agent (Pontron S-34; Oriental Chemical Industries) | 5 pbw |
| Carbon black (MOGAL L; Cabot, Inc.) | 8 pbw |

SP: softening point
pbw: parts by weight

The aforesaid materials were adequately mixed using a Henschel mixer, and cooled after mixing with a twin-shaft extrusion kneader. The cooled material was then coarsely pulverized by a hammer mill, and subsequently finely pulverized by a jet pulverizer, and thereafter classified to obtain toner particles having a mean particle size of 8.0 μm.

To the aforesaid toner particles were added 0.4 percent by weight of hydrophobic silica powder having a BET specific surface area of 110 $m^2/g$ (H2000; NIPPON AEROSIL Co. Ltd.) and 0.2 percent by weight of conductive titanium oxide having a BET specific surface area of 46 $m^2/g$ (EC300 Titan Kogyo), the mixture then mixed to obtain toner 1.

Toner 2

Toner 2 was produced in the same manner as the aforesaid example of toner 1 with the exception that 65 parts by weight of polyester resin A2 (softening temperature: 111.4° C.) and 35 parts by weight of polyester resin B2 (softening temperature: 154.2° C.) were used.

Toner 3

Toner 3 was produced in the same manner as the aforesaid example of toner 1 with the exception that 75 parts by weight of polyester resin A3 (softening temperature: 108.3° C.) and 25 parts by weight of polyester resin B3 (softening temperature: 152.5° C.) were used.

Toner 4

Toner 4 was produced in the same manner as the aforesaid example of toner 3 with the exception that 40 parts by weight of polyester resin A3 and 60 parts by weight of polyester resin B3 were used.

Toner 5

Toner 5 was produced in the same manner as the aforesaid example of toner 3 with the exception that 65 parts by weight of polyester resin A3 and 35 parts by weight of polyester resin B3 were used, and the added amount of oxided polypropylene was 2 parts by weight.

Toner 6

Toner 6 was produced in the same manner as example of toner 5 with the exception that the added amount of oxided polypropylene was 4 parts by weight.

Toner 7

Toner 7 was produced in the same manner as the example of toner 5 with the exception that the added amount of oxided polypropylene was 2 parts by weight, and one part by weight of oxided polyethylene (Sanwax E-250P (acid value 19.5); Sanyo Kasei) was also added.

Toner 8

Toner 8 was produced in the same manner as the example of toner 5 with the exception that the added amount of oxided polypropylene was 3 parts by weight.

Toner 9

Toner 9 was produced in the same manner as the aforesaid example of toner 1 with the exception that 65 parts by weight of polyester resin A4 (softening temperature: 103.7° C.) and 35 parts by weight of polyester resin B4 (softening temperature: 142.9° C.) were used.

Toner 10

Toner 103 was produced in the same manner as the aforesaid example of toner 1 with the exception that 65 parts by weight of polyester resin A5 (softening temperature: 118.3° C.) and 35 parts by weight of polyester resin B5 (softening temperature: 158.6° C.) were used.

Toner 11

Toner 11 was produced in the same manner as toner 3 with the exception that 80 parts by weight of polyester resin A3 and 20 parts by weight of polyester resin B3 were used.

Toner 12

Toner 12 was produced in the same manner as toner 3 with the exception that 30 parts by weight of polyester resin A3 and 70 parts by weight of polyester resin B3 were used.

Toner 13

Toner 13 was produced in the same manner as toner 5 with the exception that oxided polypropylene was not added.

Toner 14

Toner 14 was produced in the same manner as toner 5 with the exception that 8 parts by weight of oxided polypropylene were added.

Toner 15

Toner 15 was produced in the same manner as toner 5 with the exception that 3 parts by weight of polypropylene (Biscol 550P; Sanyo Kasei) were added instead of the aforesaid oxided polypropylene.

Toner 16

Toner 16 was produced in the same manner as toner 5 with the exception that 3 parts by weight of polyethylene (Sanwax 171P; Sanyo Kasei) were added instead of the aforesaid oxided polypropylene.

| Carrier | |
|---|---|
| Polyester resin (Mn: 5,000; Mw: 115,000; Tg: 67° C.; Tm: 123° C.) | 100 pbw |
| Ferrite fine particles (MFP-2; TDK) | 500 pbw |
| Dispersing agent colloidal silica (AERISL #200; NIPPON AEROSIL Co. Ltd.) | 3 pbw |

pbw: parts by weight

The above materials were adequately mixed using a Henschel mixer, and cooled after mixing using a twin-shaft extrusion kneader, and thereafter coarsely pulverized, then finely pulverized using a jet mill. Finally the material was classified using an air classification device to obtain a carrier having a mean particle size of 60 μm.

The previously described toners 1~16 and the aforesaid carrier were mixed to achieve a toner mixture ratio of 7 percent by weight to produce the developers of toner examples 1~8 and reference examples 9~16.

EXPERIMENT 1

Fixing evaluation: fixing strength and non-offset boundary

The fixing device of a commercial electrophotographic printer (model SP-500; Minolta Co.) was removed therefrom and used as the evaluation device. The developer of each example and reference example were loaded in the evaluation device, and prefixing image samples were made having a maximum optical reflection density of 1.4~1.5 as measured by a Macbeth reflection density metering device. The prefixing image samples were toner images electrostatically adhered to the surface of a transfer sheet.

The image samples were used to produce fixed image samples at variable fixing temperatures of 120°~240° C. using a fixing tester (fixing device) capable of variable fixing roller temperature and having a fixing roller of 40 mm in diameter, roller pressure of 40 kg (total pressure), system speed of 165 mm/sec (32 pages/min).

Fixing strength

A rectangular shaped sanded rubber member was supported at a 45° angle relative to the fixed image sample, a load of 1 kg was applied thereon and reciprocatingly moved three times over the image sample, and the optical reflection density of the image before and after rubbing by the sanded rubber member was measured by Macbeth reflection density metering device. The fixing rate [(pre-rubbing density/post rubbing density)x100] was calculated for each fixing temperature, and the fixing roller temperature achieving a fixing rate of 85% and greater was determined by quadratic regression calculation of the aforesaid data for each fixing temperature, and these data were used to evaluate fixing strength. These evaluations were made at a system speed of 165 mm/sec, and fixing was accomplished at the normal fixing temperature for copiers and printers having such system speed, i.e., typically 180°~190° C. Thus, the fixing temperature for achieving the aforesaid fixing strength may be a suitably low temperature of 170° C. or less via the aforesaid fixing temperature.

Non-offset boundary

The non-offset boundary was expressed as the fixing roller temperature range wherein toner adhesion did not occur. The presence or absence of toner adhesion (presence/absence of adhesion on the image sample of toner offset from the fixing roller) from the fixing roller to the image sample was visually verified for the passage of each image sample.

Toner breakdown (dot reproducibility) evaluation

Dot images of 2×2 dot (400 dpi) resolution were produced using the previously mentioned electrophotographic printer (model SP-500; Minolta Co.), and fixed at a fixing roller temperature of +30° C. to achieve an 85% fixing rate using the previously mentioned fixing tester. (In the present invention, the 400 dpi dot images were electrostatic latent images and fixed toner images formed in the previously described manner and under the aforesaid conditions.)

After fixing, the dot images were measured for the diameter of each image using an image analyzer to obtain about 80~100 individual dot datum, which were used to determine maximum diameter values Dmax and standard deviation σ; the data are ranked below.

Dmax: less than 187.5 μm was ranked 10, and 207 μm or greater was ranked 1; intermediate rankings therebetween for a total of 10 ranks σ: standard deviation of less than 11 μm was ranked 10, and 19 μm or greater was ranked 1; intermediate rankings therebetween for a total of 10 ranks Toner dot reproducibility rankings were determined on a worse-case ranking for each Dmax and standard deviation. The results are shown in Table 1.

Numerical values corresponding to the ranking of each Dmax and standard deviation (σ) are shown below.

| Ranking | Dmax (μm) | Standard Deviation σ (μm) |
|---|---|---|
| 10 | less than 187.5 | less than 11 |
| 9 | 187.5~less than 190.0 | 11~less than 12 |
| 8 | 190.0~less than 192.5 | 12~less than 13 |
| 7 | 192.5~less than 195.0 | 13~less than 14 |
| 6 | 195.0~less than 197.5 | 14~less than 15 |
| 5 | 197.5~less than 200.0 | 15~less than 16 |
| 4 | 200.0~less than 202.5 | 16~less than 17 |
| 3 | 202.5~less than 205.0 | 17~less than 18 |
| 2 | 205.0~less than 207.5 | 18~less than 19 |
| 1 | 207.5 or greater | 19 or greater |

Filming evaluation

Images and the surface of the photosensitive member were visually evaluated after printing 10,000 printouts using an electrophotographic printer (model SP-500; Minolta Co.). When filming occurs, the gloss of the surface of the photosensitive member becomes dulled, adequate image density cannot be obtained even with suitable exposure levels, and background fog occurs. In the table, the o mark indicates no filming of the photosensitive member surface; the A mark indicates verified slight filming on the photosensitive member surface without discernable image noise due to filming; the X mark indicates definite filming of the photosensitive member surface with definite image noise due to filming. The evaluation results are shown in Table 1.

TABLE 1

| | Experiment 1 | | | |
|---|---|---|---|---|
| | Dot reprod-uctivity :Ranking | Fixing strength (°c.) | Non-offset boundary (°c.) | Film-ing |
| Ex. 1 | 8 | 132 | 130~213 | o |
| Ex. 2 | 10 | 188 | 135~240 | o |
| Ex. 3 | 8 | 148 | 138~208 | o |
| Ex. 4 | 9 | 160 | 133~240 | o |
| Ex. 5 | 9 | 158 | 138~220 | o |
| Ex. 6 | 8 | 152 | 135~240 | o |
| Ex. 7 | 9 | 150 | 133~240 | o |
| Ex. 8 | 9 | 158 | 138~238 | o |
| Ref. 1 | 2 | 125 | 130~170 | o |
| Ref. 2 | 10 | 172 | 140~240 | o |
| Ref. 3 | 5 | 143 | 135~168 | o |
| Ref. 4 | 10 | 175 | 130~240 | o |
| Ref. 5 | 10 | 160 | 138~160 | o |
| Ref. 6 | 6 | 152 | 133~240 | Δ |
| Ref. 7 | 9 | 154 | 138~180 | x |
| Ref. 8 | 9 | 148 | 135~180 | x |

Experiment 2

Fixing strength and non-offset boundary were evaluated in the same manner as in experiment 1 with the exception that fixing tester with variable fixing roller temperature of experiment 1 was changed to a fixing tester having fixing roller diameter of 60 mm, system speed of 382 mm/sec (60 pages/min), roller pressure of 100 kg (total pressure).

Fixing strength evaluation was conducted at a system speed of 382 mm/sec, and fixing was accomplished at 200° C., a typical temperature for copiers and printers capable of such system speed. Thus, the fixing temperature for obtaining the aforesaid fixing strength may be 190° C. or less, suitably lower than conventionally.

Experiment 3

Fixing strength and non-offset boundary were evaluated in the same manner as in experiment 1 with the exception that fixing tester with variable fixing roller temperature of experiment 1 was changed to a fixing tester having fixing roller diameter of 35 mm, system speed of 112 mm/sec (21 pages/min), roller pressure of 40 kg (total pressure).

Fixing strength evaluation was conducted at a system speed of 112 mm/sec, and fixing was accomplished at 160°~170° C., a typical temperature for copiers and printers capable of such system speed. Thus, the fixing temperature for obtaining the aforesaid fixing strength may be 150° C. or less, suitably lower than conventionally.

TABLE 2

| | Experiment 2 | | Experiment 3 | |
|---|---|---|---|---|
| | Fixing strenght (°c.) | Non-offset boundary (°c.) | Fixing strenght (°c.) | Non-offset bounary (°c.) |
| Ex. 1 | 165 | 148–240 | 123 | 120–183 |
| Ex. 2 | 185 | 168–240 | 148 | 128–220 |
| Ex. 3 | 158 | 163–240 | 136 | 120–180 |
| Ex. 4 | 179 | 152–240 | 140 | 125–215 |
| Ex. 5 | 178 | 150–240 | 140 | 123–198 |
| Ex. 6 | 175 | 148–240 | 136 | 128–210 |
| Ex. 7 | 168 | 145–240 | 136 | 125–200 |
| Ex. 8 | 178 | 150–240 | 142 | 123–200 |
| Ref. 1 | 158 | no boundary | 120 | 120–160 |

TABLE 2-continued

| | Experiment 2 | | Experiment 3 | |
|---|---|---|---|---|
| | Fixing strenght (°c.) | Non-offset boundary (°c.) | Fixing strenght (°c.) | Non-offset bounary (°c.) |
| Ref. 2 | 203 | 173–240 | 158 | 144–240 |
| Ref. 3 | 150 | 158–220 | 132 | 120–150 |
| Ref. 4 | 198 | 152–240 | 160 | 135–220 |
| Ref. 5 | 182 | 152–210 | 142 | no boundary |
| Ref. 6 | 172 | 148–240 | 138 | 128–205 |
| Ref. 7 | 173 | 150–230 | 136 | 120–140 |
| Ref. 8 | 168 | 148–228 | 133 | 120–145 |

The present invention provides a toner for use with heating roller type fixing methods, said toner having excellent dot reproducibility and fixing characteristics.

The present invention provides a toner for use with heating roller type fixing methods, said toner having excellent offset resistance without causing filing of the photosensitive member.

The present invention further provides a toner for use with heating roller type fixing methods which can be used with electrophotographic devices having a wide range of system speeds.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A toner for developing a digital-image and being fused onto a recording medium by heat and pressure, said toner comprising:

a coloring agent;

a first polyester resin polycondensated from an ether diphenol with a compound selected one or more from the group consisting of a bivalent aromatic carbonic acid, an anhydride acid thereof and a low-molecular alkyl ester thereof, said first resin having a softening temperature of 105° C.–112° C.;

a second polyester resin polycondensated from an ether diphenol with a first compound selected one or more from the group consisting of a bivalent aromatic carbonic acid, an anhydride acid thereof and a low molecular alkyl ester thereof, and a second compound selected one or more from the group consisting of a carbonic acid having a polyvalent value more than trivalent value, an anhydride acid thereof and a low-molecular alkyl ester thereof and a polyhydric alcohol having a polyvalent value more than trivalent value, said second resin having a softening temperature of 150° C.–155° C. wherein a mix ratio of the first resin to the second resin is between from 75/25 to 40/60;

and an oxidated polyolefin of 1–6 parts by weight to the mix of 100 parts by weight.

2. A toner of claim 1 wherein the ether diphenol is selected one or more from the group consisting of a polyoxypropylene bisphenol A and a polyoxyethylene bisphenol A.

3. A toner of claim 2 wherein the polyoxypropylene bisphenol A is selected one or more from the group consisting of a polyoxypropylene, (2,2)-2,2-bis(4-hydroxyphenyl) propane, polyoxypropylene, (3,2)-2,2-bis(4-hydroxyphenyl) propane, a polyoxypropylene (3,3)-2,2-bis(4-hydroxyphenyl) propane, a polyoxypropylene (6)-2,2-bis(4-hydroxyphenyl) propane and the polyoxyethylene bisphenol A is a polyoxyethylene (2,0)-2,2-bis(4-hydroxyphenyl) propane.

4. A toner of claim 1 wherein the bivalent aromatic carbonic acid is selected one or more from the group consisting of a maleic acid, a fumaric acid, a citraconic acid, an itaconic acid, a glutamic acid, a phthalic acid, an isophthalic acid, a terephthalic acid, a cyclohexanedicarbonic acid, a succinic acid, an adipic acid, a sebacic acid, an azelaic acid, a malonic acid, an alkenylsuccinic acid, an alkylsuccinic acid, an anhydride acid thereof and a low-molecular ester thereof.

5. A toner of claim 1 wherein the carbonic acid having a polyvalent value more than trivalent value is selected one or more from the group consisting of a 1,2,4-benzene tricarbonic acid, a 1,2,5-benzene tricarbonic acid, a 2,5,7-naphthalene tricarbonic acid, a 1,2,4-naphthalene tricarbonic acid, a 1,2,4-butane tricarbonic acid, a 1,2,5-hexane tricarbonic acid, a 1,3-dicarboxy-2-methyl-2methylenecarboxypropane, a 1,2,4-cyclohexane tricarbonic acid, tetra(methylenecarboxyl) methane, a 1,2,7,8-octanetetracarbonic acid, a pyromellitic acid, an anhydride thereof and a low-molecular alkyl ester.

6. A toner of claim 1 wherein the polyhydric alcohol having a polyvalent value more than trivalent value is selected one or more from the group consisting of a sorbitol, a 1,2,3,6-hexanetetrol, a 1,4-sorbitane, a pentaerythritol, a dipentaerythritol, a tripentaerythritol, a 1,2,4-butanetriol, a 1,2,5-pentanetriol, a glycerol, a 2-methylpropanetriol, a 2-methyl-1,2,4-butanetriol, a trimethyolethane, a trimethyol propane and a 1,3,5-trihydroxy methylbenzene.

7. A toner of claim 1 wherein the first polyester resin is polycondensated from the ether diphenol of polyoxyethylene-bisphenol A and polyoxypropylene-bisphenol A with the bivalent aromatic carbonic acid and a trivalent aromatic carbonic acid.

8. A toner of claim 1 wherein the second polyester resin is polycondensated from the ether diphenol of polyoxyethylene-bisphenol A and polyoxypropylene-bisphenol A with the bivalent aromatic carbonic acid, the trivalent aromatic carbonic acid and a bivalent fatty acid.

9. A toner of claim 1 wherein the toner having the following characteristic:

Dmax<192.5 wherein Dmax represents a diameter of a toner image developed from an electrostatic latent image formed to be a mesh image having a 400 dots-per-inch.

10. A toner of claim 1 wherein the toner having the following characteristic:

SD<13 wherein SD represents a standard deviation of a toner image developed from an electrostatic latent image formed to be a mesh image having a 400 dots-per inch.

11. A toner of claim 1 wherein the oxidated polyolefin has an acid value between 3 and 25.

12. A toner of claim 1 further comprising a fluid agent of 0.05~2% by weight.

13. A toner of claim 1 wherein said toner has an average particle size of 5~9.

14. A toner of claim 12 further comprising an electric conductive agent of 0.05~2% by weight.

15. A toner of claim 14 wherein said electric conductive agent is selected one or more from the group consisting of a titanium dioxide treated by a tin oxide and a titanium dioxide treated by a tin oxide and an antimony oxide.

16. A toner for developing a digital-image and being fused onto a recording medium by heat and pressure, said toner comprising:

coloring agent;

a first polyester resin having a softening temperature of 105° C.–112° C.;

a second polyester resin having a softening temperature of 150° C.–155° C. wherein a mix ratio of the first resin to the second resin is between from 75/25 to 40/60;

an oxidated polyolefin having an acid value between 3 and 25; and silica particles blended with the toner and having a specific surface area of 80–150.

17. A toner of claim 16 wherein the toner having the following characteristic:

Dmax<192.5 wherein Dmax represents a diameter of a toner image developed from an electrostatic latent image formed to be a mesh image having a 400 dots-per-inch.

18. A toner of claim 16 wherein the toner having the following characteristic:

SD<13 wherein SD represents a standard deviation of a toner image developed from an electrostatic latent image formed to be a mesh image having a 400 dots-per-inch.

19. A toner of claim 16 wherein said silica particles is treated by a hydrophobic agent selected from one or more agents from the group consisting of a silane coupling agent, a titanium coupling agent, a high-molecular fatty acid and a silicone oil.

20. A toner of claim 16 wherein said silica particles are blended for 0.05~2.0 weight % to the toner.

21. A toner of claim 16 wherein said toner has an average particle size of 5~9.

22. A toner of claim 16 further comprising an electric conductive agent.

23. A toner of claim 22 wherein said electric conductive agent is selected from one or more agents from the group consisting of a titanium dioxide treated by a tin oxide and a titanium dioxide treated by a tin oxide and an antimony oxide.

24. A toner of claim 16 wherein said oxidated polyolefin has a carboxy group.

25. A toner of claim 16 wherein said oxidated polyolefin is blended with the toner for 1–6 parts by weight to 100 parts by weight of the resin of the toner.

26. A toner of claim 16 further comprising a magnetic agent.

27. A toner of claim 16 further comprising a negative charge controlling agent.

* * * * *